US006624576B1

(12) United States Patent
Mittler

(10) Patent No.: US 6,624,576 B1
(45) Date of Patent: Sep. 23, 2003

(54) SEALED-IN FOIL AND ASSOCIATED LAMP CONTAINING THE FOIL

(75) Inventor: Bodo Mittler, Neusaess (DE)

(73) Assignee: Patent-Treuhand-Gesellschaft für elektrische Glühlampen mbh, Munich (DE)

( * ) Notice: Subject to any disclaimer, the term of this patent is extended or adjusted under 35 U.S.C. 154(b) by 223 days.

(21) Appl. No.: 09/705,026

(22) Filed: Nov. 2, 2000

(30) Foreign Application Priority Data

Dec. 20, 1999 (DE) ..... 199 61 551

(51) Int. Cl.[7] ..... H01J 61/36

(52) U.S. Cl. ..... 313/623; 313/625; 313/626; 313/332

(58) Field of Search ..... 313/633, 634, 313/623, 624, 625, 626, 332

(56) References Cited

U.S. PATENT DOCUMENTS 5,021,711 A 6/1991 Madden et al.
5,200,669 A * 4/1993 Dixon et al. ..... 313/623
5,264,759 A * 11/1993 Lewandowski et al. ..... 313/623
6,265,817 B1 * 7/2001 Steinmann et al. ..... 313/332
6,375,533 B1 * 4/2002 Torikai et al. ..... 313/625

FOREIGN PATENT DOCUMENTS

| | | |
|---|---|---|
| DE | 30 06 846 | 9/1980 |
| EP | 0309749 | 4/1989 |
| FR | 2449968 | 9/1980 |
| GB | 2057498 | 4/1981 |

* cited by examiner

*Primary Examiner*—Ashok Patel
(74) *Attorney, Agent, or Firm*—Frishauf, Holtz, Goodman & Chick, P.C.

(57) ABSTRACT

A sealed-in foil lamp comprising a metal base member of molybdenum and a coating applied on at least a portion thereof, the coating containing ruthenium alone or a ruthenium alloy.

15 Claims, 3 Drawing Sheets

SEALED-IN FOIL AND ASSOCIATED LAMP CONTAINING THE FOIL

BACKGROUND OF THE INVENTION

1. Field of the Invention

The present invention relates to a sealed-in foil and associated lamp containing the sealed-in foil. The present invention relates in particular to molybdenum foils which are used in press seals, such as are standard for sealing incandescent lamps and discharge lamps.

2. Background Information

U.S. Pat. No. 5,021,711 describes a sealed-in foil and associated lamp containing the foil. In order to be better protected from oxidation, the foil is provided with a protective layer of Al, Cr, Si, Ti or Ta. The thickness of the foil ranges from 5 to 100 nm.

A similar technique is described in German Patent A 30 06 846, in which layers of Ta, Nb, V, Cr, Ti, Y, La, Hf or Sc are used for the same purpose. The layer thickness ranges from 10 to 200 nm.

In practice, partial chrome plating is usually used to protect the molybdenum foils from oxidation in the region of the welded connection between the foil and the pin. In this extremely labor-intensive method, the welded connections made between the pin and the foil by resistance welding are manually forced into a sand-like medium to the height up to which chrome plating is to be applied. Partial chromium deposition by chemical reactions takes place in a process which is not very environmentally sound. Improved thermal stability of the foil-pin connections is achieved by this chromium deposition (oxidation protection). Thus thermal stability up to about 550° C. is possible.

In some lamps it is not oxidation of the foil-pin connections that is responsible for failure of the foil seal, but attack on the molybdenum foil by the corrosive fill constituents (such as metal halides) or even fill gases. Heretofore this corrosion has been limited by sand-blasting the molybdenum foil, thus leading to an improvement of the glass-to-metal joint. Sand blasting leads to high reject rates in resistance welding, however, since thereby nonconductive $Al_2O_3$ particles remain on the Mo foil surface. Moreover, the wear of the resistance welding. electrodes increases toga great degree. In sand-blasted foils, the electrodes have to be replaced after about 70 welding operations (compared with a replacement interval of about 1000 weld operations for untreated foil), and so the electrodes have to be changed frequently.

SUMMARY OF THE INVENTION

The object of the present invention is to provide a sealed-in foil which is well protected from oxidation and corrosion and. in which weldability is nevertheless assured to the greatest extent possible. This object is achieved by the present invention.

To prevent-oxidation and corrosion, and to achieve good weldability, according to the present invention, a molybdenum foil is coated partly or preferably all over with pure ruthenium or a compound or alloy containing ruthenium. Pure ruthenium in particular, as well as a molybdenum-ruthenium alloy of a eutectic composition, is suitable as the coating material.

The present invention is thus directed to a sealed-in foil for a lamp comprising a metal base member of pure molybdenum or doped molybdenum, and a coating comprising a ruthenium-containing layer applied on at least a portion of the metal base member.

The present invention also concerns a lamp containing such sealed-in foil.

The present invention further relates to a lamp comprising a lamp vessel made of a hard glass or quartz glass, the lamp vessel enclosing a discharge space, a luminous agent contained within the discharge space of the lamp vessel, an interior current lead, one end of which passes into the discharge space, and a seal provided at an end of the lamp vessel, the seal comprising a gas-tight feedthrough which surrounds a portion of the interior current lead, the gas-tight feedthrough comprising a molybdenum foil, at least a portion of the molybdenum foil being provided with a ruthenium-containing layer made of a ruthenium-containing material.

The present invention further concerns a process for making an electrically conductive-connection between a molybdenum foil and a metal wire comprising providing a molybdenum foil having at least a portion thereof with a ruthenium-containing coating and connecting the metal wire to the foil in a region containing the coating.

BRIEF DESCRIPTION OF THE DRAWINGS

For the purpose of illustrating the invention, the present invention will be explained in more detail hereinafter on the basis of several practical examples with reference to the drawings. It is to be understood, however, that the present invention is not limited to the precise arrangements and instrumentalities depicted in the drawings.

DETAILED DESCRIPTION OF THE INVENTION

Figure 1:
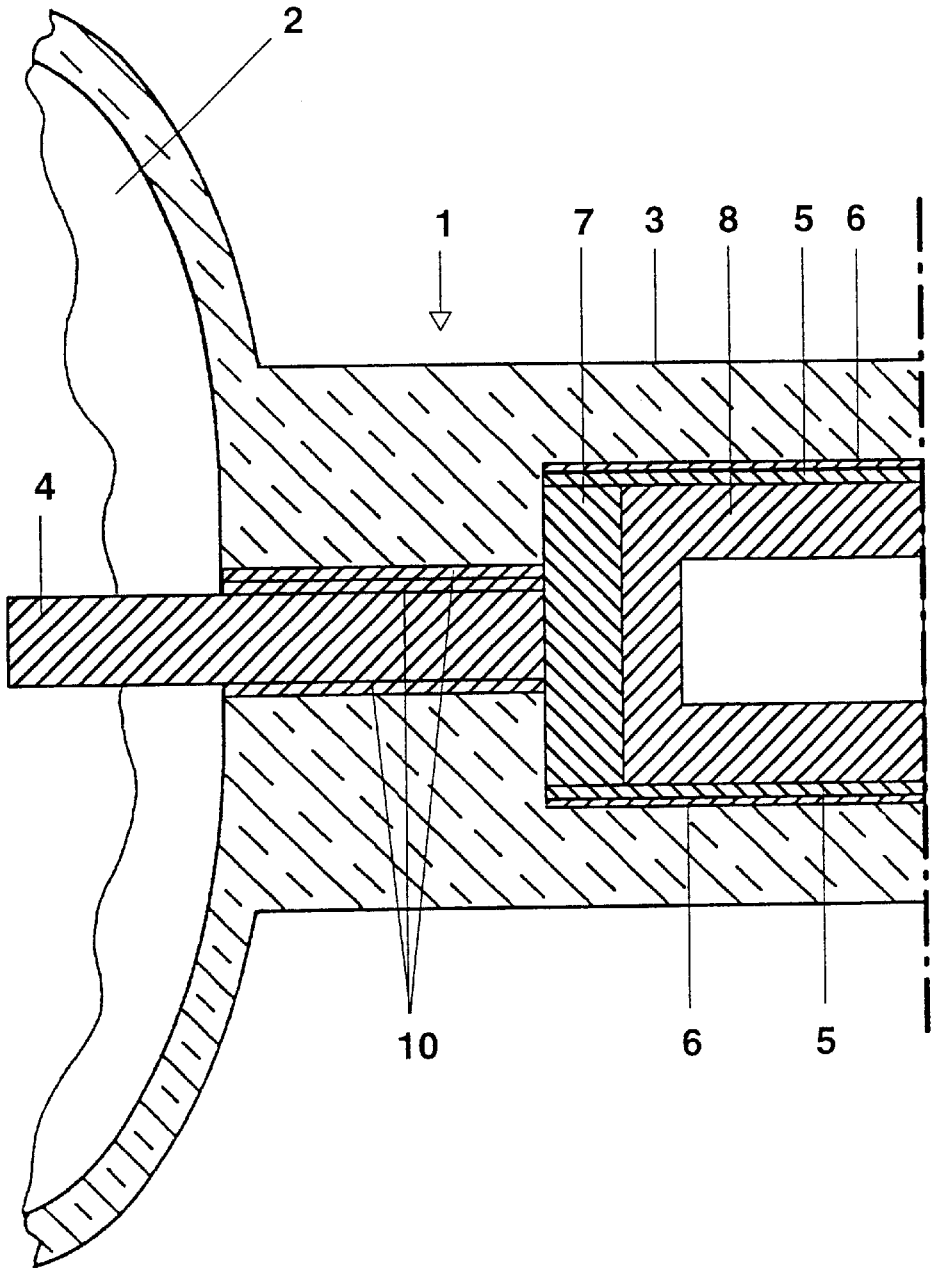
FIG. 1 is a cross-sectional view of a portion of a metal halide lamp.

The thickness of the ruthenium-containing layer preferably ranges from 0.02 to 1.0 $\mu$m. In a particularly preferred embodiment of the present invention, the layer thickness ranges from 0.02 to 0.09 $\mu$m.

The coating can be applied by known coating methods, preferably by sputtering.

The molybdenum foils coated with ruthenium or a ruthenium alloy have very good weldability, in contrast to molybdenum foils coated with chromium, silicon, aluminum or similar elements.

In a preferred embodiment of the present invention, the oxidation resistance of the welded connections between the pin and the foil can be increased by coating the current leads with coating materials identical or similar to those which can be used. for the molybdenum foil.

Electric lamps according to the present invention have a lamp vessel made of quartz glass or hard glass provided with molybdenum-foil feedthroughs, which are part of at least one press seal of the lamp vessel. At least one molybdenum foil is pinched gas-tightly in the at least one press seal. The molybdenum foil or the molybdenum foils are provided according to the present invention with a ruthenium-containing coating.

The application of a layer of ruthenium (pure or as an alloy) on the foil makes it possible for the first time to connect filament current leads (which may have the form of windings) securely and simply to the foil. Instead of resistance welding in association with a paste (molybdenum or platinum), as has been used heretofore and is suitable only for massive current leads or results in a very high reject rate in the case of filament current leads, it is now possible to perform a brazing, process (preferably using a eutectic MoRu alloy), for which relatively low temperatures suffice (typically about 360° C. lower than in the case of pure Ru). Temperatures of 1900 to 2000° C. are now possible instead of about 2300° C.

Preferably the interior current lead is uncoiled and has a diameter of 10 to 100 μm, especially 10 to 50 μm.

In a particularly preferred embodiment of the present invention, the interior current lead is singly coiled and has an outside diameter of 20 to 150 μm, especially 20 to 80 μm.

A process for manufacture of an electrically conductive connection between a molybdenum foil and a metal wire, especially with a diameter of between 10 and 100 μm, is characterized in that the foil is provided with a ruthenium-containing coating in the region of the surface in contact with the wire. The wire is made in particular of tungsten.

In a further embodiment of the present invention, the metal wire can be singly coiled and thus forms a winding. In particular, the outside diameter of the winding can range between 20 and 80 μm.

In the preferred practical example of the present invention illustrated schematically in FIG. 1, there is shown a high-pressure discharge lamp with an electrical power consumption of about 24,000 W. The lamp has a discharge vessel 1 made of a hard glass or quartz glass. The discharge vessel 1 is provided with a discharge space 2 and two cylindrical bulb stems 3 disposed on diametrically opposite ends-of the discharge space 2. Only a detail of one of the bulb stems 3 in a cutaway view is illustrated in FIG. 1. Two tungsten electrodes 4 extend from discharge space 2, each into one of bulb stems 3, where each is brazed to a round molybdenum plate 7. Four molybdenum foils 5 disposed regularly along the cylindrical face of a hollow quartz glass rod 8 are welded to the molybdenum plate 7. The hollow quartz glass rod 8 is inserted together with molybdenum foils 5 into the inside of the hollow bulb stem 3. Molybdenum foils 5 form a gas-tight sealed in unit with the quartz glass of the bulb stem 3 and the quartz glass of the hollow glass rod 8. Molybdenum foils 5 sealed into the quartz glass are provided with a ruthenium coating 6 of 75 nm. Electrode 4 is wrapped in the region of bulb stem 3 with a molybdenum foil 10 which, however, is not sealed into the quartz glass.

Figure 2:
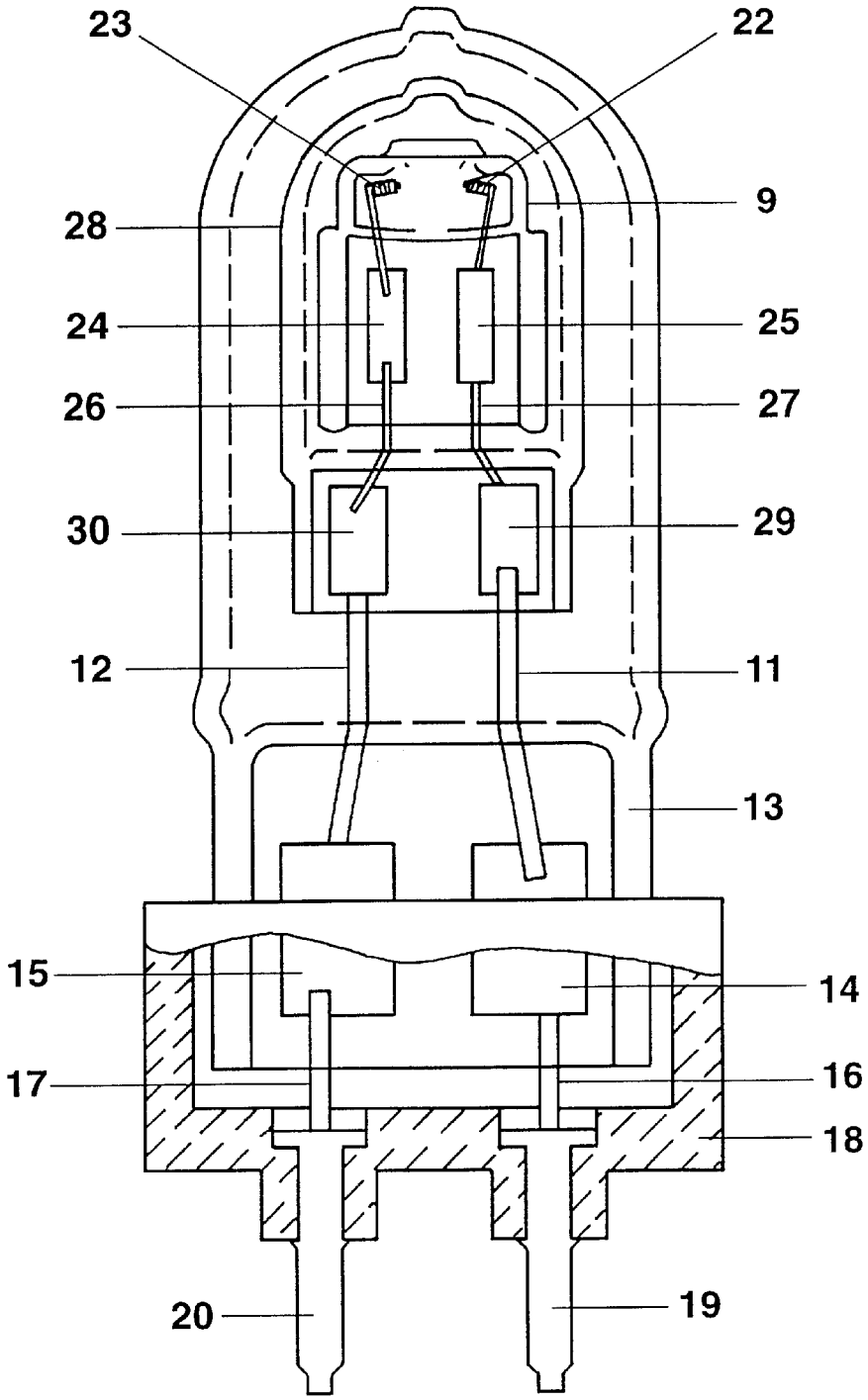
FIG. 2 is an elevational view, partly in cross-section, which shows an example of an incandescent lamp.

In the practical example of the present invention illustrated in FIG. 2, there is shown a high-pressure discharge lamp with a base at one end. This lamp has a discharge vessel 9 of quartz glass with a press seal at one end, in which vessel there is enclosed gas-tightly an ionizable fill comprising corrosive metal halides. Inside discharge vessel 9 there are disposed two electrodes 22, 23, each of which is connected electrically conductively via a molybdenum foil 24, 25 embedded in the press seal of discharge vessel 9 to a current lead 26, 27 extending out of discharge vessel 9. Discharge vessel 9 is completely surrounded at a narrow spacing therefrom by a gas-tightly sealed envelope bulb 28 having a press seal at one end. The envelope bulb 28 is made of quartz glass doped with about 0.5 weight percent of cerium. The inside of the envelope bulb 28 contains nitrogen gas, which at room temperature has a cold filling pressure of between 600 and 700 mbar. Current leads 26, 27 extending out of the discharge vessel 9 are each connected electrically conductively via a molybdenum foil 29, 30 embedded in the press seal bottom of the envelope bulb 28 to a current lead 11, 12 extending out of the envelope bulb 28. An exterior bulb 13 with a press seal and base at one end encloses the envelope bulb 28 gas-tightly. The exterior bulb 13 is evacuated and is also made of quartz glass doped with about 0.5 weight percent of cerium. Current leads 11, 12 extending out of the envelope bulb 28 are each connected electrically conductively via a molybdenum foil 14, 15 embedded in the press seal of the exterior bulb 13 to a current lead 16, 17 extending out of the exterior bulb 13. The current leads 16, 17 extending out of exterior bulb 13 are in electrical contact with the contact pins 19, 20 projecting out of base 18. The molybdenum foils used in this practical example are all coated with a eutectic Mo—Ru alloy of 500 nm thickness. The composition of the alloy is as follows: molybdenum 43 wt %, ruthenium 57 wt % (preferably at least 40%, advantageously more than 50% ruthenium). The current leads 26, 12 and 17 are coated with an Mo—Ru alloy.

Figure 3:
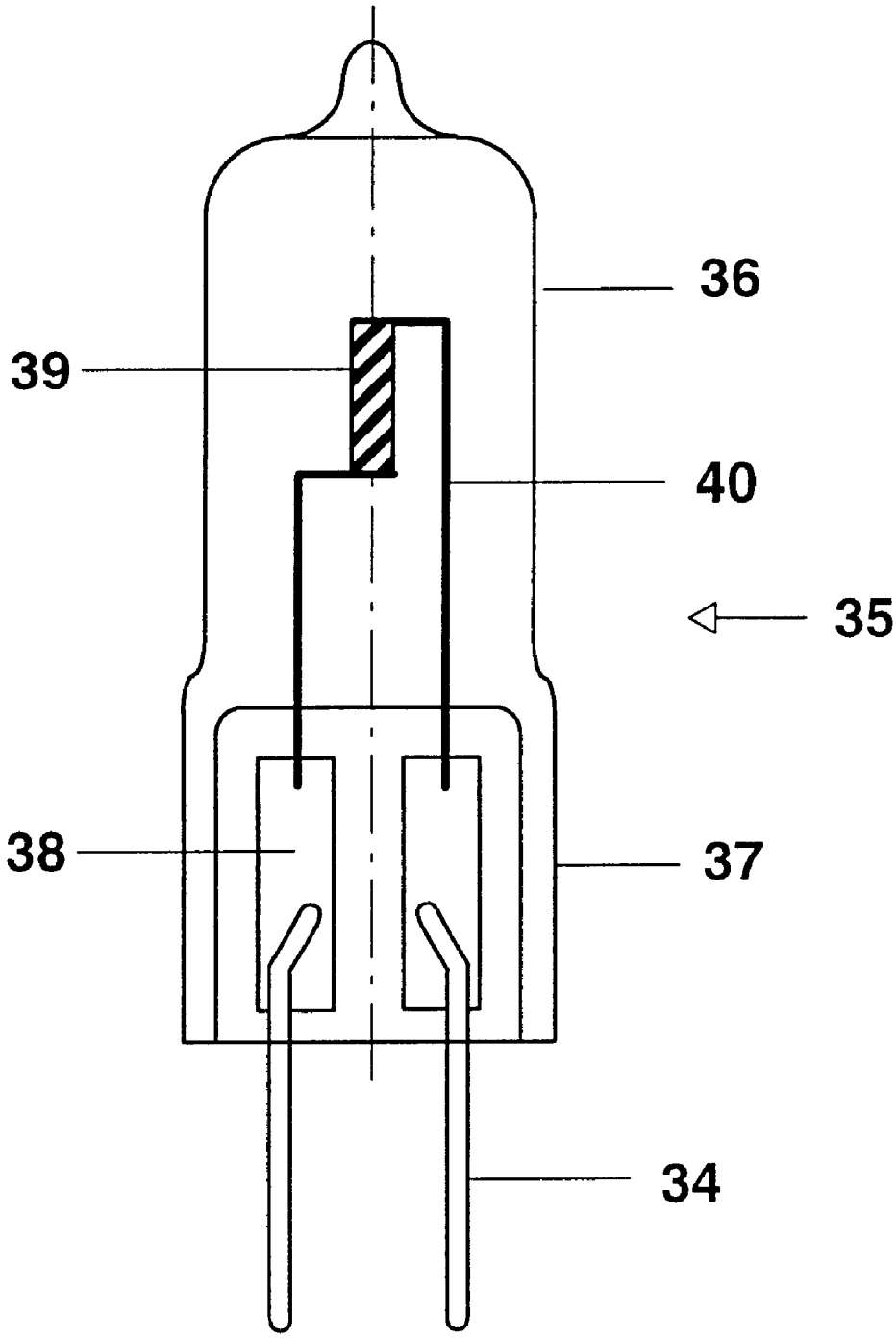
FIG. 3 is an elevational view which shows a further example of a detail of a metal halide lamp.

In the practical example of FIG. 3 there is shown an incandescent halogen lamp 35 (12 V with 100 W power) with a lamp bulb 36 of quartz glass, which is sealed gas-tightly by means of a press seal 37. Two molybdenum foils 38 are embedded in the press seal of the lamp bulb 36. Inside the lamp bulb 36 there is disposed a double-coiled luminous element 39, whose singly coiled ends function as interior current lead 40. The interior current leads are each welded to a molybdenum foil 38 embedded in the press seal 37. Out of the press seal 37 there extend two exterior current leads 34, each of which is connected to one of the two molybdenum foils 38. The two molybdenum foils 38 embedded in the press seal 37 are coated with a eutectic, Mo—Ru alloy of 90 nm thickness at one end, which is the end to which the coiled lead 40 is secured.

The coil lead 40 is made of a singly coiled tungsten wire having a thickness of 15 μm. The wire has an outside diameter of 55 μm. The coil lead 40 and the foil 38 are connected to each another by a brazing process. The special advantage of the present invention lies in the fact that heretofore it was necessary to use for resistance welding a powder layer (coarsely powdered molybdenum), into which the winding was pressed. Heretofore, during passage of current for the welding process, numerous short circuits developed due to the inhomogeneous powder layer. This led to high reject rates and imposed a lower limit of about 80 μm on the outside diameter of the singly coiled current lead, whereas according to the present invention, corresponding outside diameters as small as between 20 and 60 μm can still be processed. In contrast to the method used heretofore, the ruthenium layer, which functions as a solder, now simultaneously wets the foil and the applied single coil. Short circuits do not occur, and so this method makes it possible to connect to a foil much smaller current leads, which in particular can be coil ends.

Even extremely fine current leads (with a thickness of only 10 to 100 μm) can be connected gently and reliably to the foil by a similar procedure. In particular, the ruthenium-coated foils appear to be especially suitable for low-voltage lamps with high power (20 W to 150 W), although use in high-voltage lamps can also be recommended. The production process is considerably simplified, since two assembly steps can be eliminated, in addition to which the manufacturing costs are as much as 70% lower. Particular suitability for halogen lamps for general lighting purposes and for automobile headlights are afforded by the present invention.

The ruthenium coating according to the present invention therefore makes possible an improved technique for connecting foil and current leads, and this principle is applicable both for interior and exterior current leads. In general, however, interior current leads are more critical. Thus it is permissible to apply the ruthenium coating at one end of the foil and merely in the proximity of the surface in contact with the current lead.

It will be appreciated that the instant specification is set forth by way of illustration and not limitation, and that various modifications and changes may be made without departing from the spirit and scope of the present invention.

What is claimed is:

1. A sealed-in foil for a lamp comprising a metal base member of pure molybdenum or doped molybdenum, and a coating comprising ruthenium applied on at least a portion of the metal base member.

2. The foil according to claim 1, wherein the coating comprises pure ruthenium or a ruthenium compound or a ruthenium alloy.

3. The foil according to claim 1, wherein the coating comprises especially a eutectic molybdenum—ruthenium alloy.

4. The foil according to claim 1, wherein the coating has a thickness of between 0.02 and 1.0 $\mu$m.

5. The foil according to claim 1, wherein the coating has a thickness between 0.02 and 0.09 $\mu$m.

6. In a lamp containing a sealed-in foil, the improvement comprising said sealed-in foil being according to claim 1.

7. A lamp comprising a lamp vessel made of a hard glass or quartz glass, the lamp vessel enclosing a discharge space, a luminous agent contained within the discharge space of the lamp vessel, an interior current lead, one end of which passes into the discharge space, and a seal provided at an end of the lamp vessel, the seal comprising a gas-tight feedthrough which surrounds a portion of the interior current lead, said gas-tight feedthrough comprising a molybdenum foil, at least a portion of the molybdenum foil being provided with a ruthenium-containing layer made of a ruthenium-containing material.

8. The lamp according to claim 7, wherein the discharge space further contains a fill.

9. The lamp according to claim 7, wherein the seal is formed as a press seal or a sealed-in unit.

10. The lamp according to claim 7, further comprising exterior current leads which are coated with a ruthenium-containing coating material.

11. The lamp according to claim 10, wherein the exterior current leads are coated with the same ruthenium-containing material of the ruthenium-containing layer of said foil.

12. The lamp according to claim 7, wherein the interior current lead is uncoiled and has a diameter of 10 to 250 $\mu$m.

13. The lamp according to claim 12, wherein the interior current lead has a diameter of 10 to 50 $\mu$m.

14. The lamp according to claim 7, wherein the interior current lead is singly coiled and has an outside diameter of 20 to 150 $\mu$m.

15. The lamp according to claim 14, wherein the interior current lead has an outside diameter of 20 to 80 $\mu$m.

* * * * *

UNITED STATES PATENT AND TRADEMARK OFFICE

CERTIFICATE OF CORRECTION

PATENT NO. : 6,624,576 B1
DATED : September 23, 2003
INVENTOR(S) : Bodo Mittler

It is certified that error appears in the above-identified patent and that said Letters Patent is hereby corrected as shown below:

Title page,
Item [56], References Cited, insert the following:
-- OTHER PUBLICATIONS
Patent Abstract of Japan, Vol. 006, No. 243 (E-145), December 2, 1992 of JP 57 143243 (Iwasaki Electric Co. Ltd.)
Data WPI, Derwent Publications, Ltd., AN 1980-52659C, XP002164795 of JP 55024233 (June 27, 1980) (Tokyo Shibaura Electric Co.) --.

Signed and Sealed this

Twentieth Day of September, 2005

JON W. DUDAS
*Director of the United States Patent and Trademark Office*